US010494889B2

(12) United States Patent
Robottom et al.

(10) Patent No.: US 10,494,889 B2
(45) Date of Patent: Dec. 3, 2019

(54) LOCKDOWN SYSTEM AND METHOD

(71) Applicant: CAMERON INTERNATIONAL CORPORATION, Houston, TX (US)

(72) Inventors: Gavin Robottom, Leeds (GB); Robert Cridland, Leeds (GB)

(73) Assignee: Cameron International Corporation, Houston, TX (US)

( * ) Notice: Subject to any disclaimer, the term of this patent is extended or adjusted under 35 U.S.C. 154(b) by 299 days.

(21) Appl. No.: 15/247,478

(22) Filed: Aug. 25, 2016

(65) Prior Publication Data

US 2018/0058168 A1 Mar. 1, 2018

(51) Int. Cl.
*E21B 33/04* (2006.01)

(52) U.S. Cl.
CPC ..... *E21B 33/0422* (2013.01)

(58) Field of Classification Search
CPC ..... E21B 33/03; E21B 33/038; E21B 33/04; E21B 33/0422; F16B 33/02
USPC ..... 403/97, 98, 320; 285/391
See application file for complete search history.

(56) References Cited

U.S. PATENT DOCUMENTS 112,958 A * 3/1871 Ramp ..... F16L 37/2445 285/391
3,442,536 A * 5/1969 Fowler ..... E21B 17/08 285/27
3,588,130 A * 6/1971 Fowler ..... E21B 33/04 277/328
3,638,725 A * 2/1972 Ahlstone ..... E21B 33/043 166/208
3,924,679 A * 12/1975 Jansen, Jr. ..... E21B 33/043 166/182
3,999,604 A 12/1976 Amancharla
4,807,705 A * 2/1989 Henderson ..... E21B 33/043 166/208
5,080,173 A * 1/1992 Brammer ..... E21B 33/043 166/208
5,403,043 A * 4/1995 Smet ..... F16L 37/2445 285/148.21
5,638,903 A 6/1997 Kent
6,283,511 B1 * 9/2001 Kamp ..... F16L 37/2445 285/334.4
7,380,607 B2 6/2008 Thomas
(Continued)

FOREIGN PATENT DOCUMENTS

WO 2015065960 A1 5/2015

OTHER PUBLICATIONS

International Search Report and Written Opinion dated Nov. 16, 2017, for International Patent Application No. PCT/US2017/048628.

*Primary Examiner* — David Carroll
(74) *Attorney, Agent, or Firm* — Conley Rose, P.C.

(57) ABSTRACT

A tubing or casing hanger assembly includes a tubing or casing hanger including a first key disposed on an outer surface of the hanger, and a locking member disposed about the hanger, the locking member including a first key disposed on an inner surface of the hanger, wherein the locking member includes a first position where the first key of the locking member is circumferentially spaced from the first key of the hanger, and a second position where the first key of the locking member circumferentially overlaps with the first key of the locking member to couple the locking member with the hanger.

18 Claims, 9 Drawing Sheets

(56) References Cited

U.S. PATENT DOCUMENTS

| | | | | |
|---|---|---|---|---|
| 2005/0285399 | A1* | 12/2005 | Mosing | F16L 37/2445<br>285/391 |
| 2011/0147009 | A1* | 6/2011 | Dupal | E21B 17/043<br>166/380 |
| 2015/0247387 | A1 | 9/2015 | Massey et al. | |

* cited by examiner

LOCKDOWN SYSTEM AND METHOD

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Hydrocarbon drilling and production systems require various components to access and extract hydrocarbons from subterranean earthen formations. Such systems generally include a wellhead assembly through which the hydrocarbons, such as oil and natural gas, are extracted. The wellhead assembly may include a variety of components, such as valves, fluid conduits, controls, casings, hangers, and the like to control drilling and/or extraction operations. In some operations, hangers, such as tubing or casing hangers, may be used to suspend strings (e.g., piping for various fluid flows into and out of the well) in the well. Such hangers may be disposed or received in a housing, spool, or bowl. In addition to suspending strings inside the wellhead assembly, the hangers provide sealing to seal the interior of the wellhead assembly and strings from pressure inside the wellhead assembly. During assembly of the wellhead assembly, various components of the assembly may require rotation to be locked into place, such as casing hangers and packoff assemblies. In some applications, an annular breech lock is used to lock the component of the wellhead assembly into position by rotating the breech lock a plurality of full revolutions (e.g., twenty revolutions) via a running tool or drill string extending to the wellhead assembly.

SUMMARY

An embodiment of a tubing or casing hanger assembly comprises a tubing or casing hanger comprising a first key disposed on an outer surface of the hanger, and a locking member disposed about the hanger, the locking member comprising a first key disposed on an inner surface of the hanger, wherein the locking member comprises a first position where the first key of the locking member is circumferentially spaced from the first key of the hanger, and a second position where the first key of the locking member circumferentially overlaps with the first key of the locking member to couple the locking member with the hanger. In some embodiments, when the locking member is disposed in the second position, the locking member is rotated about a longitudinal axis from the first position. In some embodiments, when the locking member is disposed in the second position, the locking member is rotated approximately 45° from the first position. In certain embodiments, the hanger comprises a plurality of first keys spaced circumferentially about the outer surface of the outer surface of the hanger, and the locking member comprises a plurality of first keys spaced circumferentially about the inner surface of the locking member. In certain embodiments, the hanger comprises a second key axially spaced from and circumferentially aligned with at least one of the plurality of first keys of the hanger, and the locking member comprises a second key axially spaced from and circumferentially aligned with at least one of the plurality of first keys of the locking member. In some embodiments, the hanger comprises an annular shoulder extending radially outwards from the outer surface, the annular shoulder axially spaced from the second key of the hanger. In some embodiments, an arcuate gap extends between each first key of the plurality of first keys of the hanger, and an arcuate gap extends between each first key of the plurality of first keys of the locking member. In some embodiments, the first key of the hanger comprises an upper arcuate surface and a lower arcuate surface, the lower surface disposed at a first acute angle relative the upper surface, and the first key of the locking member comprises an upper arcuate surface and a lower arcuate surface, the upper surface disposed at the first acute angle relative the lower surface.

An embodiment of a tubing or casing hanger comprises a tubing or casing hanger comprising a first key disposed on an outer surface of the hanger, wherein the first key comprises an upper arcuate surface and a lower arcuate surface, the lower surface disposed at a first acute angle relative the upper surface, and a locking member disposed about the hanger, the locking member comprising a first key disposed on an inner surface of the locking member, wherein the first key comprises an upper arcuate surface and a lower arcuate surface, the upper surface disposed at the first acute angle relative the lower surface. In some embodiments, the locking member comprises a first position where the first key of the locking member is circumferentially spaced from the first key of the hanger, and a second position where the first key of the locking member circumferentially overlaps with the first key of the locking member to couple the locking member with the hanger. In some embodiments, when the locking member is disposed in the second position, the lower surface of the first key of the hanger engages the upper surface of the first key of the locking member at an offset engagement interface. In certain embodiments, the offset engagement interface is disposed at a non-orthogonal angle relative to a longitudinal axis of the tubing or casing hanger assembly. In certain embodiments, the lower surface of the first key of the hanger is disposed at a non-orthogonal angle relative to a longitudinal axis of the tubing or casing hanger assembly, and the upper surface of the first key of the locking member is disposed at a non-orthogonal angle relative to the longitudinal axis of the tubing or casing hanger assembly. In some embodiments, in response to actuating the locking member from the first position to the second position, the locking member is displaced axially relative to the hanger due to engagement between the first key of the hanger and the first key of the locking member at the offset engagement interface. In some embodiments, the hanger comprises a second key axially spaced from and circumferentially aligned with the first key of the hanger, the second key comprising an upper arcuate surface and a lower arcuate surface, the lower surface disposed at a first acute angle relative to the upper surface, the locking member comprises a second key axially spaced from and circumferentially aligned with the first key of the locking member, the second key comprising an upper arcuate surface and a lower arcuate surface, the upper surface disposed at the first acute angle relative to the lower surface, and the hanger comprises an annular shoulder extending radially outwards from the outer surface, the annular shoulder axially spaced from the second key of the hanger. In certain embodiments, the hanger comprises a plurality of first keys spaced circumferentially about the outer surface of the outer surface of the hanger, and the locking member comprises a plurality of first keys spaced circumferentially about the inner surface of the locking member.

An embodiment of a method of actuating a tubing or casing hanger assembly comprises disposing a locking member about a tubing or casing hanger, the locking member comprising a key disposed on an inner surface thereof and the hanger comprising a key disposed on an outer surface thereof, rotating the locking member from a first position where the key of the locking member is circumferentially spaced from the key of the hanger to a second position where the key of the locking member circumferentially overlaps the key of the hanger, and coupling the locking member to the hanger in response to rotating the locking member from the first position to the second position. In some embodiments, the method further comprises locking a packoff assembly in an energized position in response to rotating the locking member from the first position to the second position. In some embodiments, the method further comprises axially displacing the locking member relative to the hanger to actuate a packoff assembly from a run-in position to an energized position. In certain embodiments, the method further comprises engaging the key of the locking member with the key of the hanger at an offset engagement interface.

BRIEF DESCRIPTION OF THE DRAWINGS

For a detailed description of exemplary embodiments, reference will now be made to the accompanying drawings in which.

DETAILED DESCRIPTION

Figure 1:
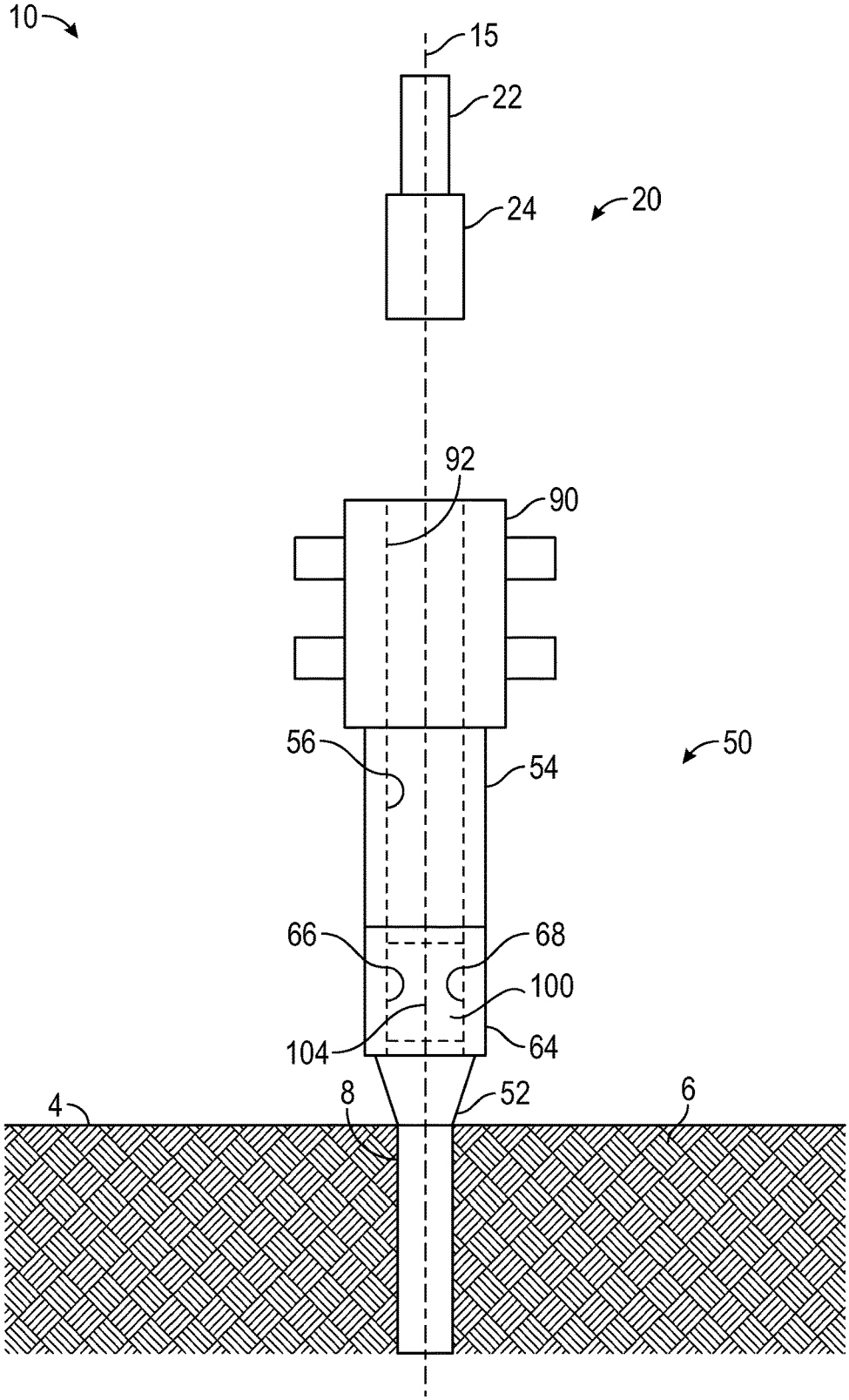
FIG. 1 is a schematic view of an embodiment of a well system in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

FIG. 1 is a schematic diagram showing an embodiment of a well system 10 having a central or longitudinal axis 15. The well system 10 can be configured to extract various minerals and natural resources, including hydrocarbons (e.g., oil and/or natural gas), or configured to inject substances into an earthen surface 4 and an earthen formation 6 via a well or wellbore 8. In some embodiments, the well system 10 is land-based, such that the surface 4 is land surface, or subsea, such that the surface 4 is the seal floor. The system 10 includes a wellhead system 50 that can receive a tool or tubular string conveyance 20. The wellhead 50 is coupled to a wellbore 8 via a wellhead connector or hub 52. The wellhead 50 typically includes multiple components that control and regulate activities and conditions associated with the wellbore 8. For example, the wellhead 50 generally includes bodies, valves and seals that route produced fluids from the wellbore 8, provide for regulating pressure in the wellbore 8, and provide for the injection of substances or chemicals downhole into the wellbore 8.

In the embodiment shown in FIG. 1, the wellhead 50 includes a Christmas tree or tree 54, a tubing and/or casing spool or housing 64, and a tubing and/or casing hanger assembly 100. For ease of description below, reference to "tubing" shall include casing and other tubulars associated with wellheads. Further, "spool" may also be referred to as "housing," "receptacle," or "bowl." A blowout preventer (BOP) 90 may also be included, either as a part of the tree 54 or as a separate device. The BOP 90 may include a variety of valves, fittings, and controls to prevent oil, gas, or other fluid from exiting the wellbore 8 in the event of an unintentional release of pressure or an overpressure condition. The system 10 may include other devices that are coupled to the wellhead 50, and devices that are used to assemble and control various components of the wellhead 50. For example, in the illustrated embodiment, the system 10 includes tool conveyance 20 including a tool 24 suspended from a tool or drill string 22. In certain embodiments, tool 24 comprises a running tool that is lowered (e.g., run) from an offshore vessel (not shown) to the wellbore 8 and/or the wellhead 50. In other embodiments, such as land surface systems, tool 24 may include a device suspended over and/or lowered into the wellhead 50 via a crane or other supporting device.

The tree 54 generally includes a variety of flow paths, bores, valves, fittings, and controls for operating the wellbore 8. The tree 54 may provide fluid communication with the wellbore 8. For example, the tree 54 includes a tree bore 56. The tree bore 56 provides for completion and workover procedures, such as the insertion of tools into the wellbore 8, the injection of various substances into the wellbore 8, and the like. Further, fluids extracted from the wellbore 8, such as oil and natural gas, may be regulated and routed via the tree 54. As is shown in the system 10, the tree bore 56 may fluidly couple and communicate with a BOP bore 92 of the BOP 90.

The spool 64 provides a base for the tree 54. The spool 64 includes a spool bore 66 defined by a generally cylindrical inner surface 68. The spool bore 66 fluidly couples to enable fluid communication between the tree bore 56 and the wellbore 8. Thus, the bores 92, 56, and 66 may provide access to the wellbore 8 for various completion and workover procedures. For example, components can be run down to the wellhead 50 and disposed in the spool bore 66 to seal off the wellbore 8, to inject fluids downhole, to suspend tools downhole, to retrieve tools downhole, and the like. For instance, casing and/or tubing hangers may be installed within spool 64 via the access provided by bores 92, 56, and 66. In some embodiments, the casing and/or tubing hangers are conveyed to the wellhead 50 via tool conveyance 20 for installation within spool bore 64. In certain embodiments, associated components of the casing and/or tubing hangers, such as seal or packoff assemblies, are installed within spool bore 66 via tool 24 of conveyance tool 20. In some embodiments the tool 24 is configured to apply a force and/or pressure to energize or "set" components of wellhead 50 within spool bore 66. In certain embodiments, tool 24 is configured to apply a torque to rotate components of wellhead 50, including components of hanger assembly 100, within spool bore 66 to set or lock the rotated component into position.

As one of ordinary skill in the art understands, the wellbore 8 may contain elevated pressures. For example, the wellbore 8 may include pressures that exceed 10,000 pounds per square inch (PSI). Accordingly, well system 10 employs various mechanisms, such as mandrels, seals, plugs and valves, to control and regulate the well 8. For example, the hanger assembly 100 is typically disposed within the wellhead 50 to secure tubing and casing suspended in the wellbore 8, and to provide a path for hydraulic control fluid, chemical injections, and the like. As will be described further herein, hanger assembly 100 includes a hanger bore 104 that extends through the center of hanger assembly 100 and is in fluid communication with the spool bore 66 and the wellbore 8.

Figure 2:
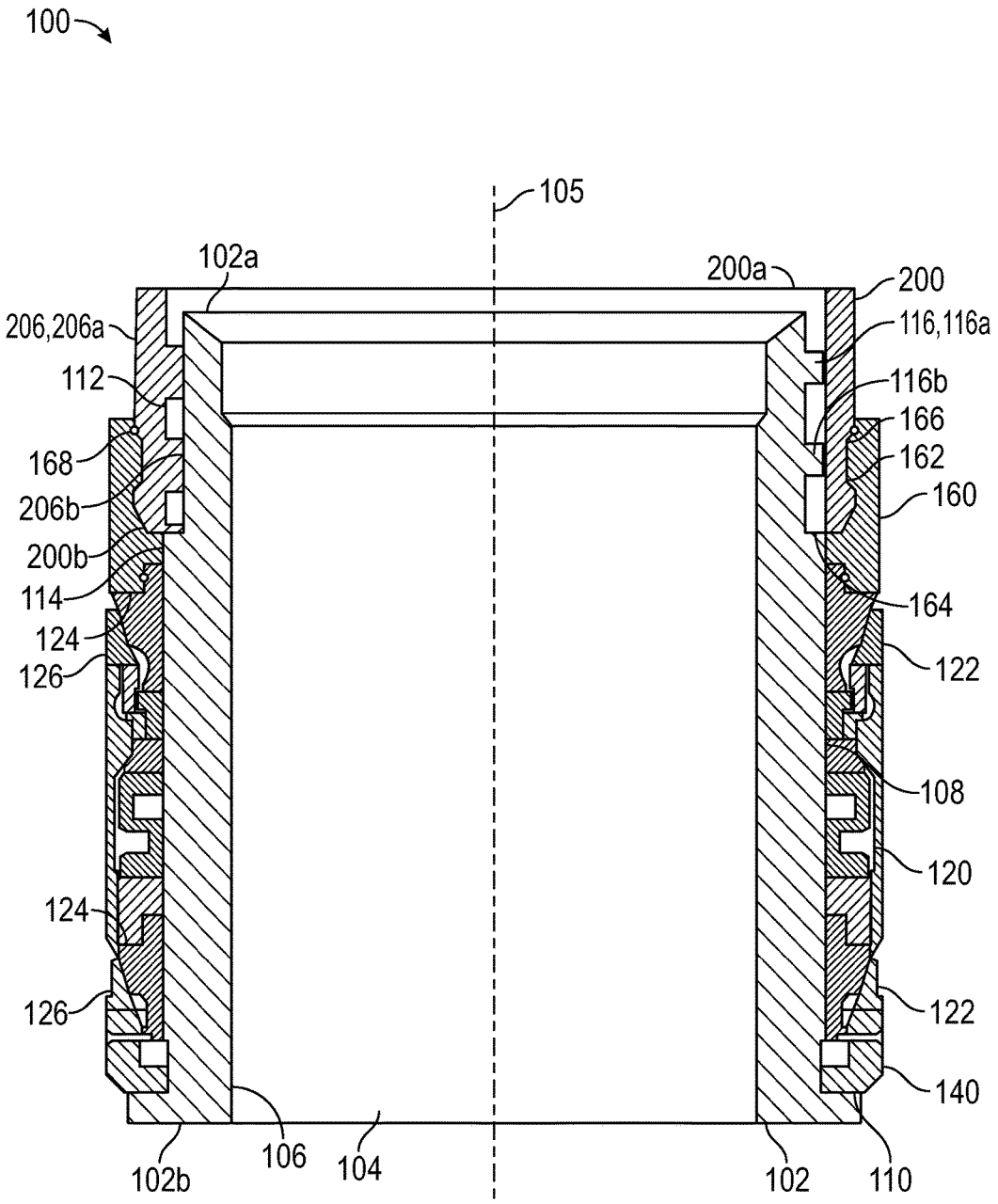
FIG. 2 is a schematic cross-sectional view of an embodiment of a tubing or casing hanger assembly of the well system of FIG. 1 shown in a run-in position in accordance with principles disclosed herein.

Referring to FIG. 2, a schematic cross-sectional view of hanger assembly 100 of the spool 64 of FIG. 1 is shown. Given that FIG. 2 provides a schematic illustration of hanger assembly 100 may include additional components not explicitly shown in FIG. 2. In the embodiment shown in FIG. 2, hanger assembly 100 has a central or longitudinal axis 105 disposed coaxial with longitudinal axis 25 of system 10 and generally includes a tubing or casing hanger 102, a packoff assembly 120, and an annular locking or lockdown member 200. Hanger 102 is configured to provide a fluid flowpath between wellhead 50 and wellbore 8, while packoff assembly 120 is configured to seal against inner surface 68 of the bore 66 of spool 64 (not shown in FIG. 2). Specifically, packoff assembly 120 includes a run-in position (shown in FIG. 2) where packoff assembly 120 is disposed in a de-energized state, and a "set" or energized position configured to seal against inner surface 68 of spool bore 66. Locking member 200 is generally configured to set or energize packoff assembly 120 following the installation of hanger assembly 100 within wellhead 50. Additionally, locking member 200 is configured to lock packoff assembly 120 in the energized position after assembly 120 has been set.

Figure 3:
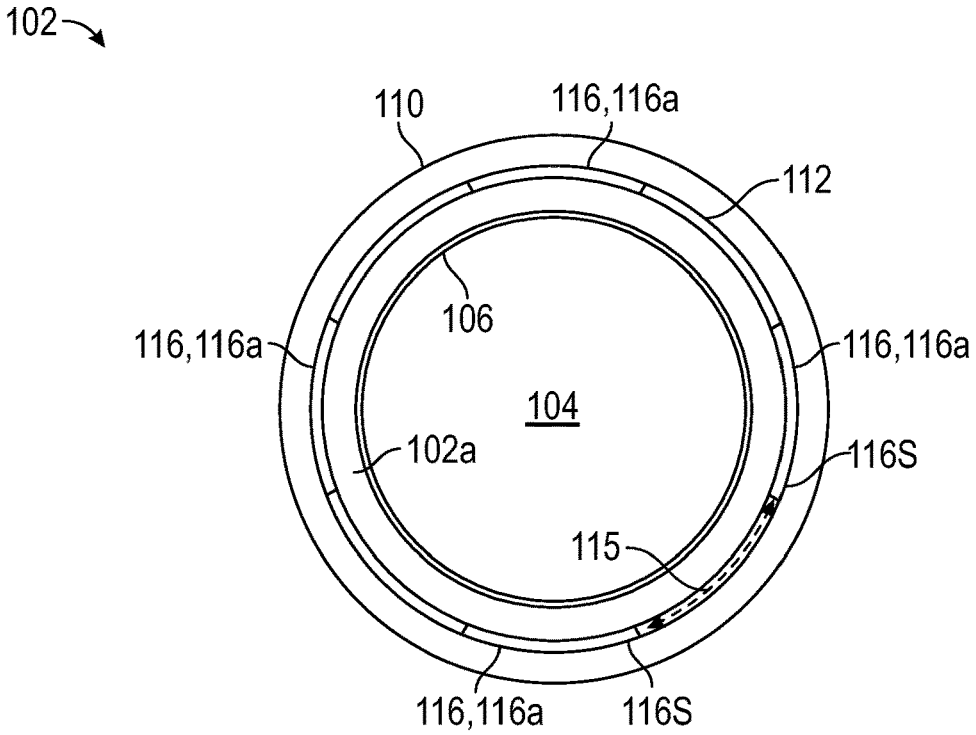
FIG. 3 is a top view of an embodiment of a tubing or casing hanger of the hanger assembly of FIG. 2 in accordance with principles disclosed herein.
Figure 4:
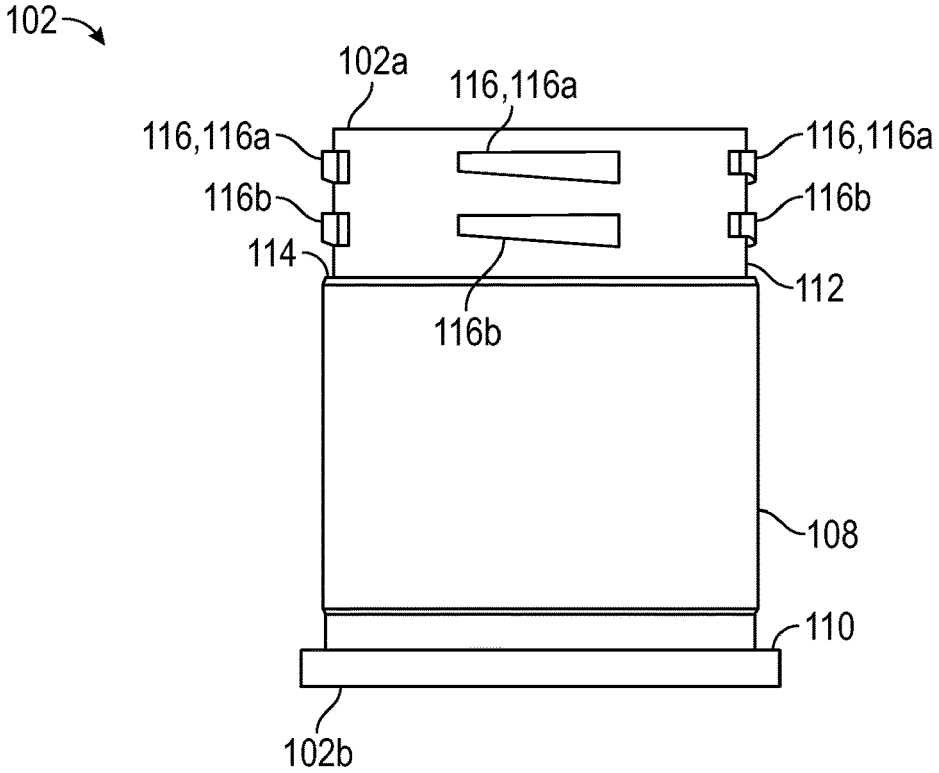
FIG. 4 is a side view of the tubing or casing hanger of FIG. 3.

Referring to FIGS. 2-4, hanger 102 has a first or upper end 102*a*, a second or lower end 102*b*, and bore 104 extending between ends 102*a* and 102*b*, where bore 104 is defined by a generally cylindrical inner surface 106. In addition, hanger 102 includes a generally cylindrical outer surface 108 extending between ends 102*a* and 102*b*, where outer surface 108 includes a radially outwards extending landing shoulder 110 for receiving the lower end of packoff assembly 120. Outer surface 108 of hanger 102 also includes a reduced diameter section or surface 112 extending from upper end 102*a* to an intermediate annular shoulder 114 axially spaced from upper end 102*a*.

Figure 5:
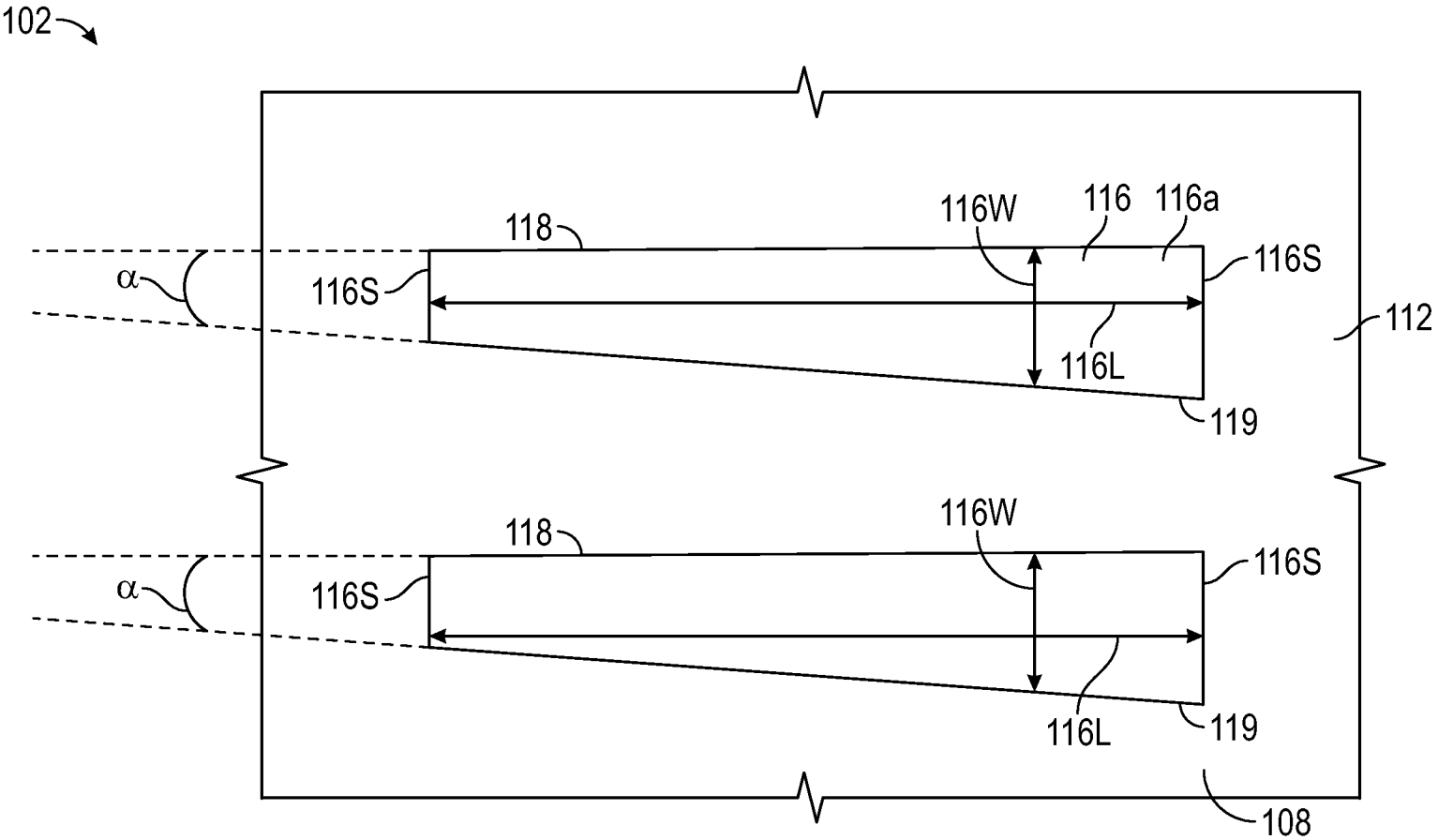
FIG. 5 is a zoomed-in side view of an embodiment of a pair of engagement keys of the tubing or casing hanger of FIG. 3 in accordance with principles disclosed herein.
Figure 6:
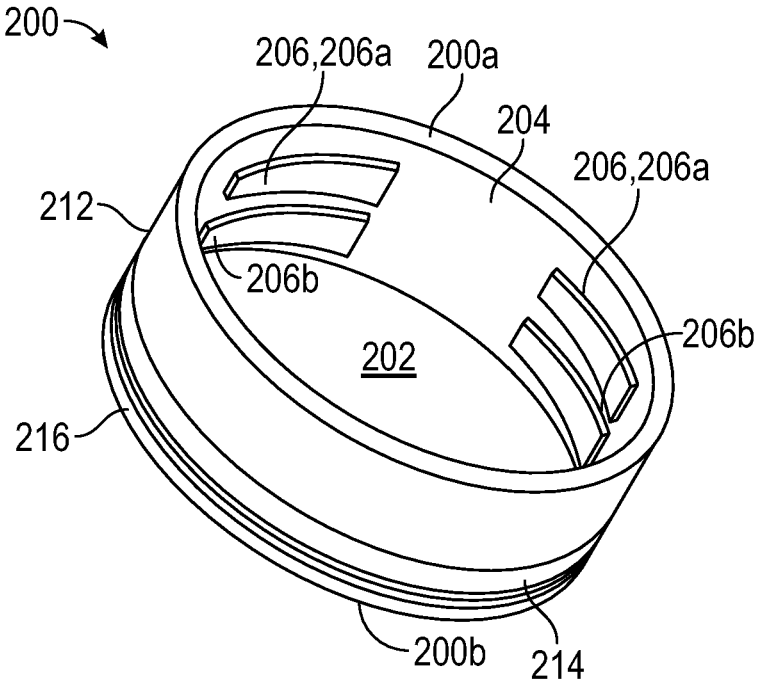
FIG. 6 is a perspective view of an embodiment of an annular locking member of the hanger assembly of FIG. 2 in accordance with principles disclosed herein.
Figure 7:
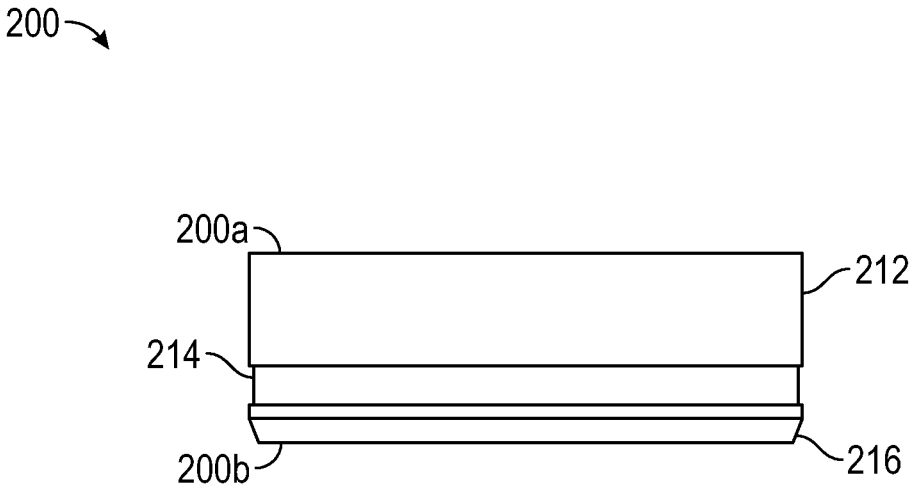
FIG. 7 is a side view of the locking member of FIG. 6.
Figure 8:
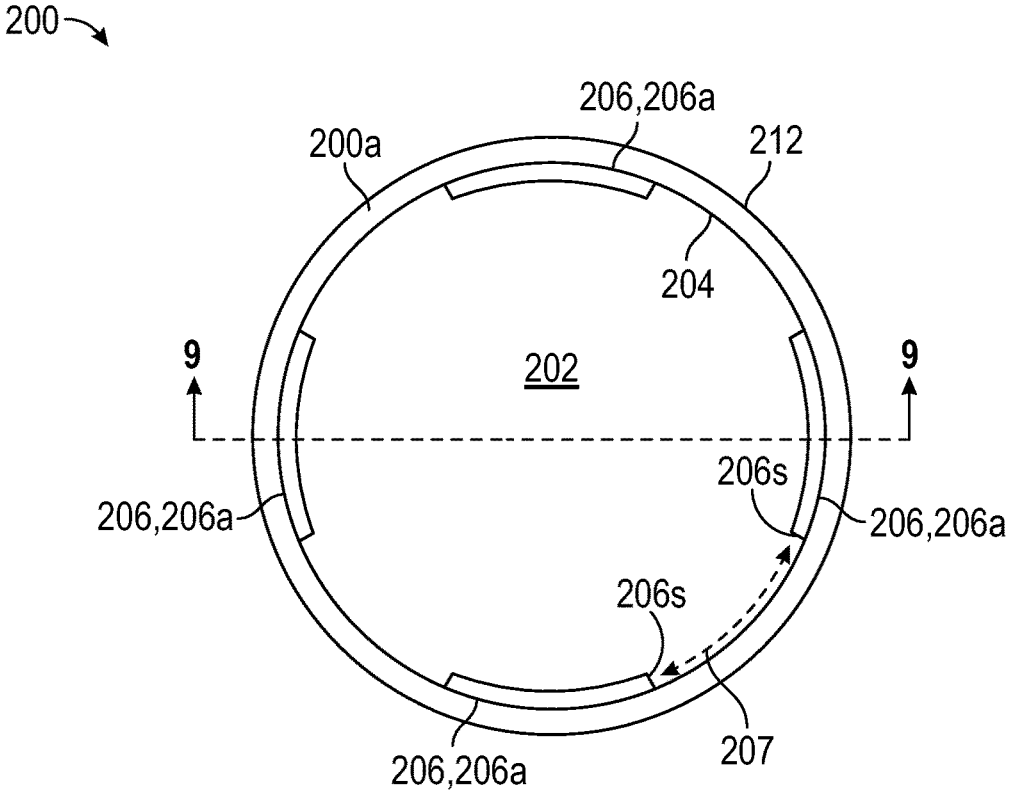
FIG. 8 is a top view of the locking member of FIG. 6.
Figure 9:
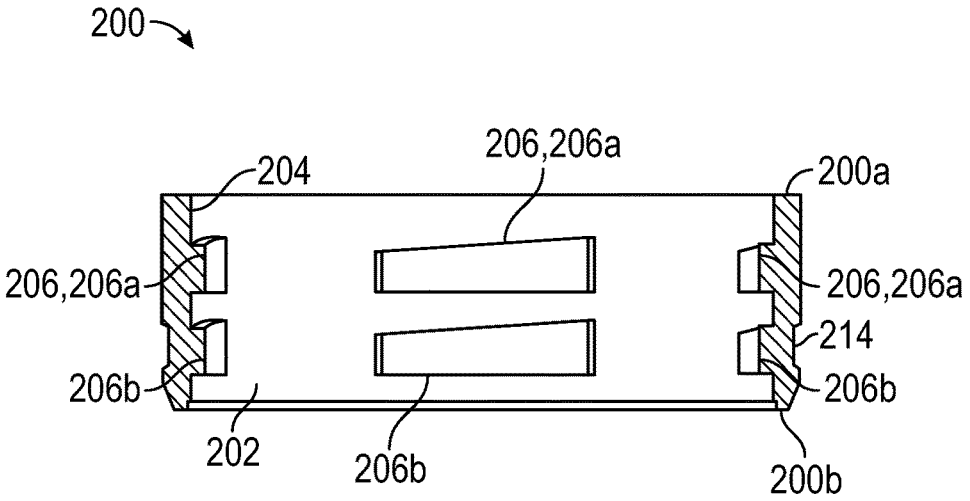
FIG. 9 is a cross-sectional view along lines 9-9 of FIG. 8 of the locking member of FIG. 6.
Figure 10:
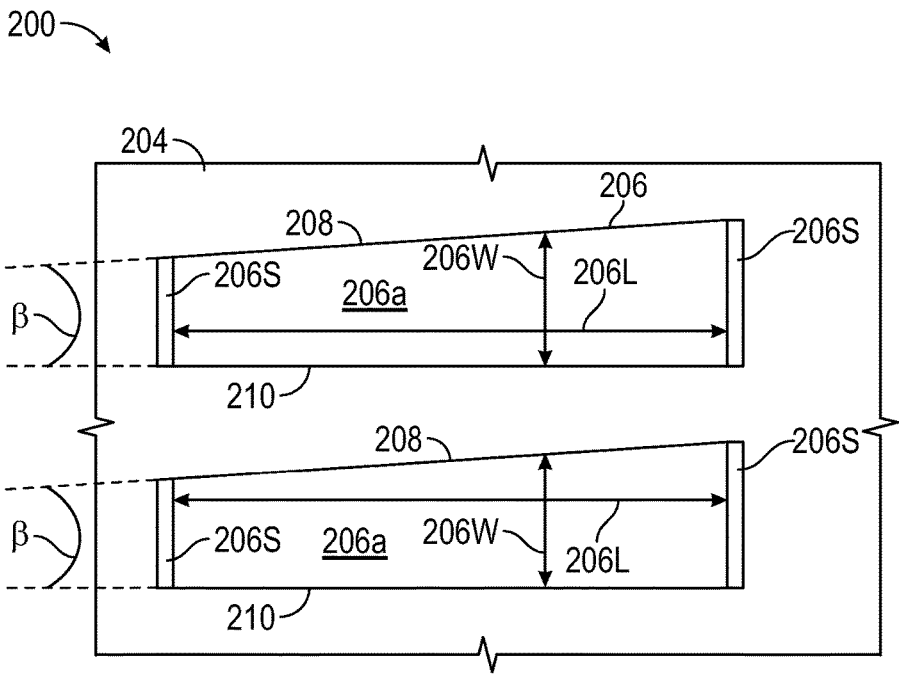
FIG. 10 is a zoomed-in side view of an embodiment of a pair of engagement keys of the locking member of FIG. 6 in accordance with principles disclosed herein.

As shown particularly in FIG. 4, reduced diameter surface 112 of hanger 102 includes a plurality of circumferentially spaced pairs of keys or splines 116 extending radially outwards therefrom. Particularly, each pair of keys 116 includes a first or upper key or spline 116*a* and a second or lower key or spline 116*b*, where the upper key 116*a* of each pair of keys 116 is circumferentially aligned with its corresponding lower key 116*b*. In this arrangement, upper and lower keys 116*a* and 116*b* of each pair of keys 116 are axially spaced, with upper key 116*a* disposed proximal upper end 102*a* of hanger 102 and lower key 116*b* disposed distal upper end 102*a* and proximal annular shoulder 114. As shown particularly in FIG. 5, each key 116 (including both upper keys 116*a* and lower keys 116*b*) includes an arcuate length 116L extending between a pair of lateral sides 116*s*. Additionally, each pair of keys 116 is circumferentially spaced, such that each pair of keys 116 extends arcuately about reduced diameter surface 112 of hanger 102, with an arcuate gap 115 (shown in FIG. 3) extending between the lateral sides 116*s* of each pair of keys 116. In the embodiment shown, hanger 102 includes four pairs of circumferentially spaced keys 116; however, in other embodiments, hanger 102 may comprise varying numbers of pairs of circumferentially spaced keys 116.

In the embodiment shown, each key 116 (including both upper keys 116*a* and lower keys 116*b*) include an arcuate upper surface 118, and an arcuate lower surface 119 axially spaced from upper surface 118. Upper surface 118 of each key 116 extends along a plane disposed orthogonal longitudinal axis 105 while the lower surface 119 of each key 116 extends along a plane disposed at a non-orthogonal angle relative longitudinal axis 105 (i.e., angled from orthogonal longitudinal axis 105). As shown particularly in the zoomed-in view of FIG. 5, lower surface 119 is disposed at an acute angle $\alpha$ relative upper surface 118. While in this embodiment the surfaces 118 and 119 of both upper keys 116*a* and lower keys 116*b* are disposed at acute angle $\alpha$, in other embodiments, the surfaces 118 and 119 of each upper key 116*a* may be disposed at a different angle than the angle disposed between the surfaces 118 and 119 of each lower key 116*b*. Further, due to the acute angle $\alpha$ disposed between upper surface 118 and lower surface 119 of each key 116, a width 116W extending between surfaces 118 and 119 of each key 116 increases moving in a first circumferential direction (counter-clockwise in FIG. 4), and decreases moving in a second circumferential direction opposite the first direction.

Referring to FIG. 2, packoff assembly 120 is shown in the run-in position. In this embodiment, packoff assembly 120 generally includes a pair of annular seals 122, an annular retainer ring 140, and an annular load ring 160. In the arrangement shown in FIG. 2, annular seals 122 are retained between retainer ring 140, which comprises a lower end of packoff assembly 120, and load ring 160, which comprises an upper end of packoff assembly 120. In the embodiment shown in FIG. 2, each annular seal 122 comprises an inner annular seal 124 in engagement with an outer annular seal 126. The inner seal 124 of each annular seal 122 sealingly engages the outer surface 108 of hanger 102 while the outer seal 126 sealingly engages the inner surface 68 of spool bore 66 when packoff assembly 120 is disposed in the energized position. As will be discussed further herein, each inner seal 124 is moveable relative to its corresponding outer seal 126 to energize or set packoff assembly 120.

Retainer ring 140 of packoff assembly 120 is disposed directly adjacent or physically engages landing shoulder 110 of hanger 102 to locate packoff assembly 120 respective hanger 102. Load ring 160 receives a load or force from locking member 200 to actuate packoff assembly 120 from the run-in position shown in FIG. 2 to the energized position shown in FIGS. 11 and 12. In this embodiment, load ring 160 is configured to receive an actuating load or force from locking member 200 to shift packoff assembly 120 from the run-in position to the energized position. Particularly, load ring 160 comprises an inner surface 162 including an annular shoulder 164 disposed proximal a lower end of load ring 160 for receiving and physically engaging a lower end of locking member 200. The inner surface 162 of load ring 160 also includes an annular groove 166 disposed therein for receiving a retainer ring 168 to couple load ring 160 with locking member 200.

Referring to FIGS. 6-10, locking member 200 has a first or upper end 200*a*, a second or lower end 200*b*, and a central bore 202 extending between ends 200*a* and 200*b* that is defined by a generally cylindrical inner surface 204. In the embodiment shown in FIGS. 6-10, inner surface 204 of locking member 200 includes a plurality of circumferentially spaced pairs of keys or splines 206 extending radially inwards therefrom. Particularly, each pair of keys 206 includes a first or upper key or spline 206*a* and a second or lower key or spline 206*b*, where the upper key 206*a* of each pair of keys 206 is circumferentially aligned with its corresponding lower key 206*b*. In this arrangement, upper and lower keys 206*a* and 206*b* of each pair of keys 206 are axially spaced, with upper key 206*a* disposed proximal upper end 200*a* of locking member 200 and lower key 206*b* disposed proximal lower end 200*b*. As shown particularly in FIG. 10, each key 206 (including both upper keys 206*a* and lower keys 206*b*) includes an arcuate length 206L extending between a pair of lateral sides 206*s*. In the embodiment shown, the arcuate length 206L of each key 206 is equal to or substantially similar in length to the arcuate length 116L of each key 116 of hanger 102.

Additionally, each pair of keys 206 is circumferentially spaced, such that each pair of keys 206 extends arcuately about inner surface 204 of locking member 200, with an arcuate gap 207 (shown in FIG. 8) extending between the lateral sides 206*s* of each pair of keys 206. In this embodiment, the arcuate gap 207 separating each pair of keys 206 is equal to or substantially similar in length to the arcuate gap 115 extending between each pair of keys 116 of hanger 102. In some embodiments, each pair of keys 206 is equidistantly spaced circumferentially about inner surface 204. Further, in certain embodiments, the arcuate gap extending between each pair of keys 206 is similar or equal to the arcuate gap extending between each pair of keys 116 of hanger 102. In the embodiment shown, locking member 200 includes four pairs of circumferentially spaced keys 206 (the same number of keys 116 of hanger 102); however, in other embodiments, locking member 200 may comprise varying numbers of pairs of circumferentially spaced keys 206. While in this embodiment locking member 200 includes pairs of spaced keys 206, in other embodiments, locking member 200 may only include a single row of circumferentially spaced keys 206, and in still further embodiments, locking member 200 may include three or more rows of circumferentially spaced keys 206, where each of the three or more rows of keys 206 is axially spaced from each other.

In the embodiment shown, each key 206 (i.e., both upper keys 206*a* and lower keys 206*b*) include an arcuate upper surface 208, and an arcuate lower surface 210 axially spaced from upper surface 208. Lower surface 210 of each key 206 extends along a plane disposed orthogonal longitudinal axis 105 of hanger assembly 100 while the upper surface 208 of each key 206 extends along a plane disposed at a non-orthogonal angle relative longitudinal axis 105 (i.e., angled from orthogonal longitudinal axis 105). As shown particularly in the zoomed-in view of FIG. 10, upper surface 208 of each key 206 is disposed at an acute angle β relative lower surface 210. While in this embodiment the surfaces 208 and 210 of both upper keys 206*a* and lower keys 206*b* are disposed at acute angle β, in other embodiments, the surfaces 208 and 210 of each upper key 206*a* may be disposed at a different angle than the angle disposed between the surfaces 208 and 210 of each lower key 206*b*.

Due to the acute angle β disposed between upper surface 208 and lower surface 210 of each key 206, a width 206W extending between surfaces 208 and 210 of each key 206 decreases moving in the first circumferential direction (counter-clockwise in FIG. 6), and increases moving in the second circumferential direction opposite the first direction. Thus, while the width 116W of each key 116 of hanger 102 increases moving in the first circumferential direction, the width 206W of each key 206 conversely decreases moving the first circumferential direction. In this embodiment, the acute angle β between upper surface 208 and lower surface 210 of each key 206 is equal to or substantially similar to acute angle α between surfaces 118 and 119 of each key 116 of hanger 112. As will be discussed herein, with acute angles α and β being substantially equal, a tolerance or gap between keys 206 of locking member 200 and the keys 116 of hanger 102 is minimized.

Locking member 200 includes a generally cylindrical outer surface 212 extending between upper end 200*a* and lower end 200*b*. In the embodiment shown in FIGS. 6-10, outer surface 212 includes an annular groove 214 extending therein that is disposed proximal lower end 200*b*. Annular groove 214 is configured to receive retainer ring 168 to couple locking member 200 with packoff assembly 120. Additionally, outer surface 212 includes a frustoconical or beveled surface 216 disposed at lower end 200*b* for remove stress raisers within locking member 200.

Figure 11:
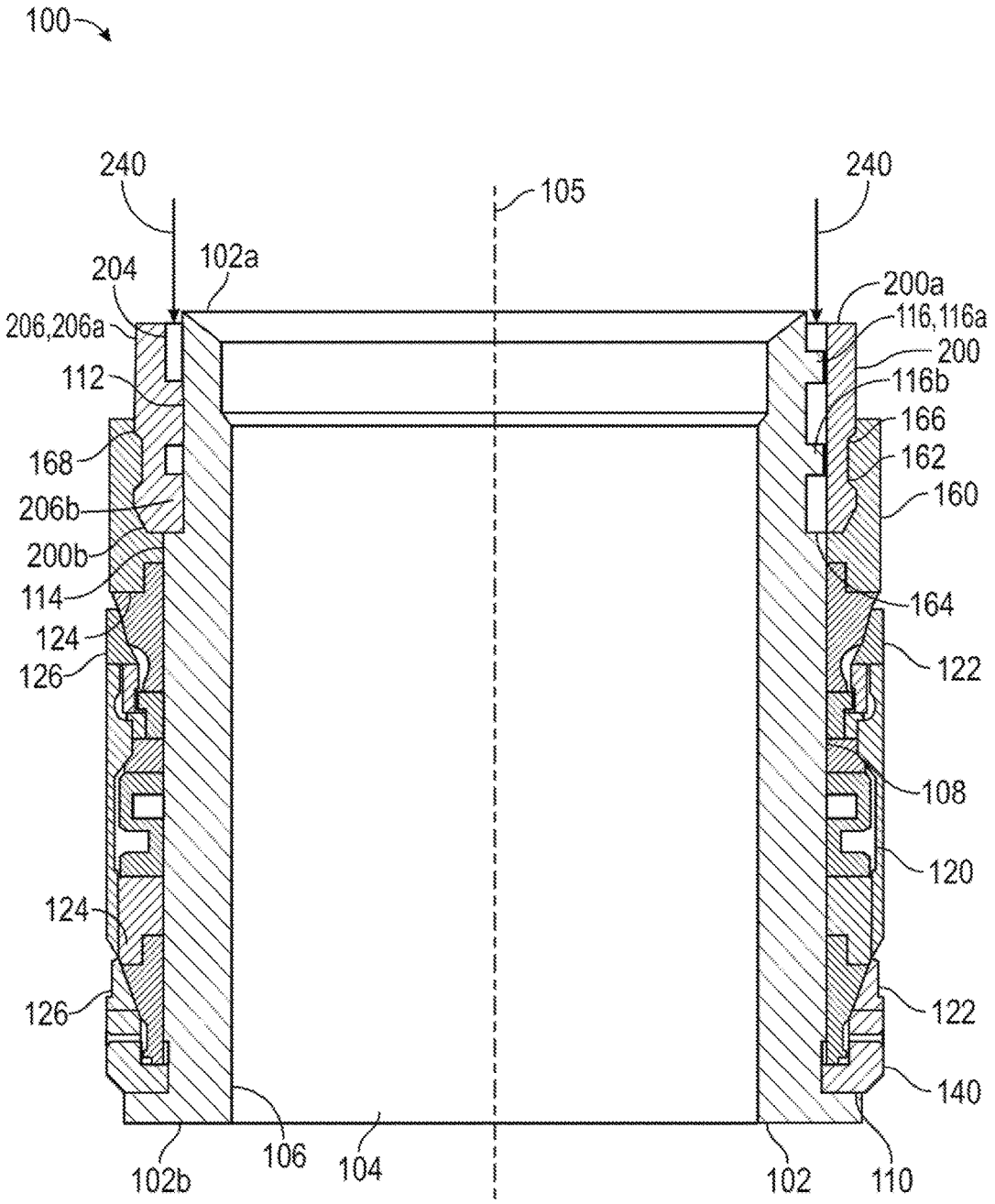
FIG. 11 is a schematic cross-sectional view of the hanger assembly of FIG. 2 shown in a set position in accordance with principles disclosed herein.
Figure 12:
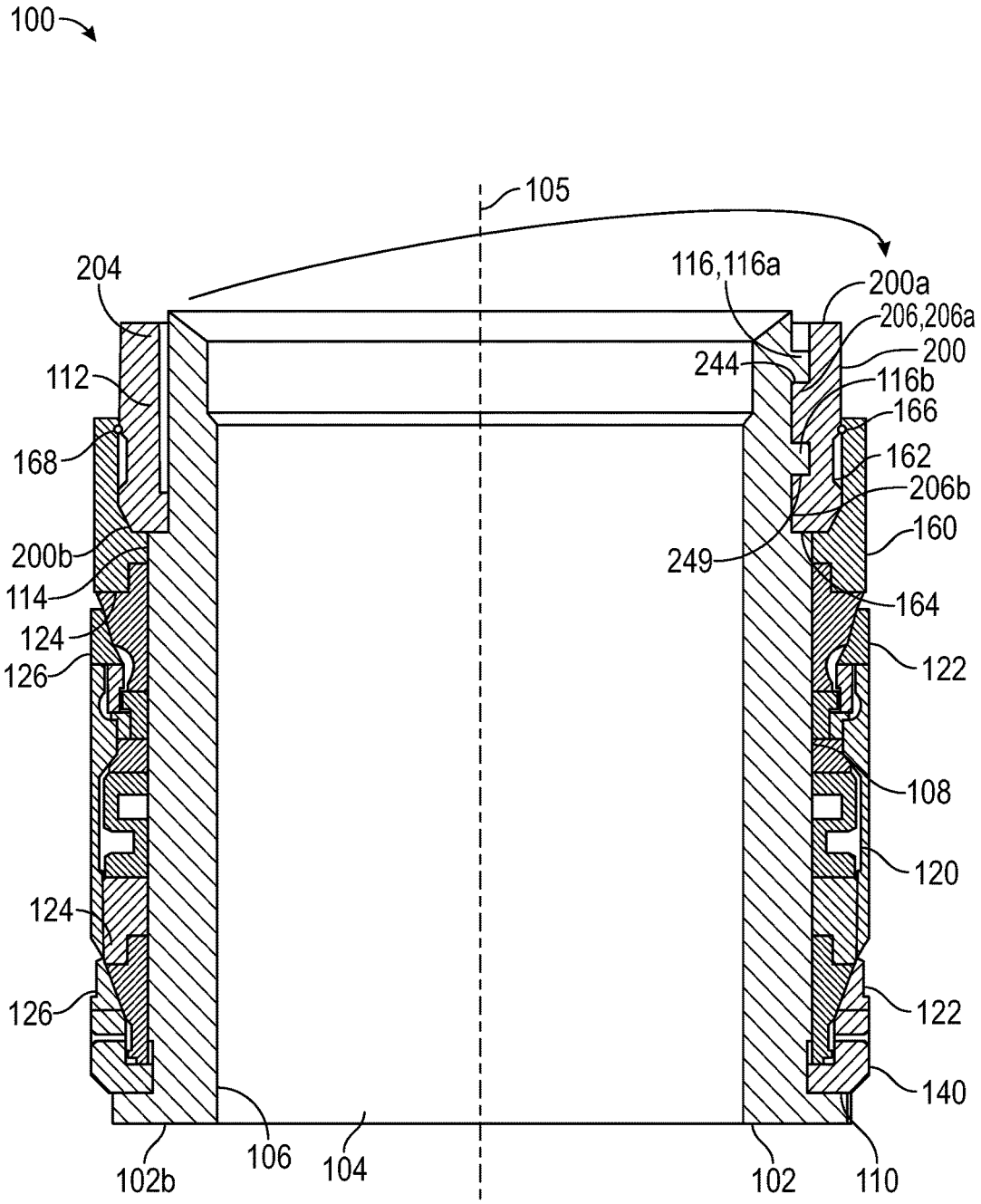
FIG. 12 is a schematic cross-sectional view of the hanger assembly of FIG. 2 shown in a locked position in accordance with principles disclosed herein.

Referring to FIGS. 2, 11, and 12, FIG. 2 illustrates packoff assembly 120 of hanger assembly 100 in the run-in position, with the lower end 200*b* of locking member 200 in engagement with the annular shoulder 164 of the load ring 160 of packoff assembly 120. In this position, packoff assembly 120 has not been set or energized to seal the inner surface 68 (shown in FIG. 1) of the spool bore 66. In this embodiment, to actuate packoff assembly 120 into the energized position, an actuation force or load 240 (shown in FIG. 11) is applied against the upper end 200*a* of locking member 200 in a substantially axially (i.e., parallel with longitudinal axis 105) downwards direction towards the annular shoulder 110 of hanger 102. The load 240 applied to the upper end 200*a* of locking member 200 is transferred to packoff assembly 120 via engagement between the lower end 200*b* of locking member 200 and the annular shoulder 164 of load ring 160 of assembly 120. Load 240 may be applied by a tubular string coupled thereto, and/or from a running tool coupled to locking member 200, such as tool 24 shown in FIG. 1

In response to the application of load 240 against the upper end 200*a* of locking member 200, locking member 200, load ring 160, and the inner annular seal 124 of each annular seal 122 shift axially downwards towards annular shoulder 110 of hanger 102, as shown particularly in FIG. 11. As the inner seal 124 of each annular seal 122 shifts downwards, a radially outwards force is applied to the outer seal 126 of each seal 122 biasing each outer seal 126 into sealing engagement with the inner surface 66 of spool bore 66 (shown in FIG. 1). The radially outwards force applied to each outer seal 126 from each corresponding inner seal 124 results due to an angled or inclined (i.e., angled relative to longitudinal axis 105) engagement interface between an inner surface of each outer seal 126 and an outer surface of each inner seal 124. With locking member 200 and inner seals 124 shifted axially downwards, and with outer seals 126 biased into sealing engagement with the inner surface 68 of spool bore 66, the packoff assembly 120 is disposed in the set or energized position. In this manner, locking member 200 is configured to actuate packoff assembly 120 from the run-in position to the energized position via transferring actuation load 240 to load ring 160, thereby axially shifting the inner seal 124 of each annular seal 122.

In the embodiment shown, locking member 200 is further configured to lock packoff assembly 120 in the energized position to thereby maintain sealing engagement between the inner surface of each inner seal 124 and the outer surface 108 of hanger 102 and the sealing engagement between the outer surface of each outer seal 126 and the inner surface 68 of spool bore 66. Particularly, locking member 200 is configured to pivot or rotate relative hanger 102 and packoff assembly 120 in response to the application of a locking torque 242 (shown in FIG. 12) to locking member 200. In FIGS. 2 and 11, each pair of keys 206 of locking member 200 is arcuately or circumferentially spaced from each pair of keys 116 of hanger 102 such that locking member 200 is disposed in a circumferentially offset position relative hanger 102 where locking member 200 is permitted to move axially relative locking member 102. In other words, when locking member 200 is disposed in the circumferentially offset position shown in FIGS. 1 and 11, each pair of keys 206 of locking member 200 is axially displaceable (i.e., in a direction parallel with longitudinal axis 105) between the arcuate gap 115 extending between each pair of keys 116 of hanger 102.

Further, when packoff assembly 120 is disposed in the run-in position shown in FIG. 2, keys 206 of locking member 200 are axially aligned or axially overlap with (i.e., are not axially spaced from) keys 116 of hanger 102, restricting premature relative rotation between locking member 200 and hanger 102 prior to the actuation of packoff assembly 120 into the energized position shown in FIG. 11. In other words, when packoff assembly 120 is disposed in the run-in position as shown in FIG. 2, each key 206 of locking member 200 is disposed directly in an arcuate gap 115 extending between two adjacent keys 116 (i.e., two arcuately adjacent upper keys 116*a* or two arcuately adjacent lower keys 116*b*) of hanger 102, preventing relative rotation of locking member 200 and hanger 102. However, when packoff assembly 102 is actuated into the energized position shown in FIG. 11, locking member 200 is axially displaced relative to hanger 102, eliminating the axial overlap and producing an axial offset between keys 206 of locking member 200 and keys 116 of hanger 102. With keys 206 of locking member 200 axially offset from keys 116 of hanger 102 when packoff assembly 120 is disposed in the energized position, relative rotation is permitted between locking member 200 and hanger 102. Specifically, when assembly 120 is disposed in the energized position, each upper key 206*a* of locking member 200 is disposed axially between upper keys 116*a* and lower keys 116*b* of hanger 102 while each lower key 206*b* of member 200 is disposed axially between lower keys 116*b* and annular shoulder 114 of hanger 102.

As shown particularly in FIGS. 11 and 12, with keys 206 of locking member 200 axially offset from keys 116 of hanger 102, the application of torque 242 rotates locking member 200 in the second circumferential direction (clockwise in FIG. 12) from the circumferentially offset position shown in FIG. 11 to a circumferentially aligned position shown in FIG. 12. In the circumferentially aligned position of locking member 200, each key 206 of locking member 200 arcuately or circumferentially overlaps with a corresponding key 116 of hanger 102 to thereby restrict relative axial movement between hanger 102 and locking member 200. Thus, with relative axial movement restricted between locking member 200 and hanger 102, packoff assembly 120 is locked or maintained in the energized position with inner seals 124 in sealing engagement with hanger 102 and outer seals 126 in sealing engagement with spool 64 (shown in FIG. 1).

Further, as locking member 200 is actuated from the circumferentially offset position shown in FIG. 11 to the circumferentially aligned position shown in FIG. 12, the angled lower surface 119 (shown in FIG. 5) of each key 116 of hanger 102 slidingly engages the angled upper surface 210 (shown in FIG. 10) of a corresponding key 206 of locking member 200. Particularly, the lower surface 119 of each upper key 116*a* of hanger 102 slidingly engages the upper surface 208 of a corresponding upper key 206*a* of locking member 200 while the lower surface 119 of each lower key 116*b* slidingly engages the upper surface 208 of a corresponding lower key 206*b* of member 200. The angled or inclined disposition of surface 119 of each key 116 and surface 208 of each key 206 forms an angled or offset (i.e., offset from longitudinal axis 105) engagement interface 244 (shown in FIG. 12) between each corresponding pair of keys 116 and 206 in sliding engagement.

Due to the offset engagement interface 244 between keys 116 and 206, rotation of locking member 200 into the circumferentially aligned position eliminates any axial tolerance between locking member 200, hanger 102, and packoff assembly 120, thereby eliminating any axial "float" of locking member 200 and packoff assembly 120 once member 200 is actuated into the circumferentially aligned position. Particularly, as locking member 200 rotates relative hanger 102, locking member 200 is displaced further axially downwards relative hanger 102 due to offset engagement interfaces 244, thereby reducing or eliminating any axial gap extending between the lower surface 210 of each upper key 206*a* of member 200 and the upper surface 118 of each adjacently disposed lower key 116*b*, and any axial gap extending between the lower surface 210 of each lower key 206*b* of member 200 and the annular shoulder 114 of hanger 102. Thus, when locking member 200 is disposed in the circumferentially aligned position shown in FIG. 12, the lower surface 210 of each upper key 206*a* is disposed adjacent but axially spaced from the upper surface 118 of an adjacently disposed lower key 116*b* of hanger 102, and the lower surface 210 of each lower key 206*b* is disposed adjacent but axially spaced from the annular shoulder 114 of hanger 102.

The sliding engagement at offset engagement interfaces 244 between keys 206 of locking member 200 and keys 116 of hanger 102 releasably couples locking member 200 to hanger 102 when member 200 is fully actuated into the circumferentially aligned position shown in FIG. 12. In addition, the offset engagement interface 244 between each key 206 of locking member 200 and each key 116 of hanger 102 reduces the total rotation of locking member 200 required to secure or lock member 200 and packoff assembly 120 into position. For example, conventional designs utilizing threads or other contrivances may require ten or more total rotations of a locking member to secure a packoff assembly in an energized position, requiring substantial time to perform the rotation of the locking member. However, in the embodiment shown, locking member 200 requires only a 45° revolution rotation relative hanger 102 to actuate member 200 from the circumferentially offset position shown in FIG. 11 to the circumferentially aligned position shown in FIG. 12 where packoff assembly 120 is locked in the energized position with any tolerance between hanger 102, assembly 120, and member 200 substantially reduced or eliminated.

Further, the arcuate gap 115 (shown in FIG. 3) extending between keys 116 of hanger 102 and the arcuate gap 207 (shown in FIG. 8) extending between keys 206 of locking member 200 provides for self-cleaning of the offset engagement interfaces 244 between keys 116 and 206. Specifically, any material or debris disposed on the engagement surfaces of keys 116 and 206 is displaced or removed therefrom in response to the sliding engagement of the engagement surfaces of keys 116 and 206, where the material is allowed to flow into arcuate gaps 115 and 207. Further, while locking member 200 is described above in the context of actuating and locking packoff assembly 120, locking member 200 may be utilized in other embodiments to actuate and/or lock other annular components, such as tubing or casing hangers.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A tubing or casing hanger assembly comprising:

a tubing or casing hanger comprising a first key and a second key each disposed on an outer surface of the hanger;

a packoff assembly disposed about the hanger; and a locking member disposed about the hanger, the locking member comprising a first key disposed on an inner surface of the locking member;

wherein the locking member comprises a first position where the first key of the locking member is circumferentially spaced from the first key of the hanger, and a second position where the first key of the locking member circumferentially overlaps with the first key of the locking member to couple the locking member with the hanger;

wherein the locking member is configured to actuate the packoff assembly from a run-in position to an energized position in response to the application of an axially directed load against the locking member;

wherein the first key of the locking member is circumferentially aligned with the first key of the hanger and an upper arcuate surface of the first key of the locking member engages the first key of the hanger while a lower arcuate surface of the first key of the locking member is axially spaced from the second key of the hanger when the locking member is in the second position.

2. The tubing or casing hanger of claim 1, wherein, when the locking member is disposed in the second position, the locking member is rotated about a longitudinal axis from the first position.

3. The tubing or casing hanger of claim 1, wherein, when the locking member is disposed in the second position, the locking member is rotated approximately 45° from the first position.

4. The tubing or casing hanger of claim 1, wherein:

the hanger comprises a plurality of first keys spaced circumferentially about the outer surface of the outer surface of the hanger; and the locking member comprises a plurality of first keys spaced circumferentially about the inner surface of the locking member.

5. The tubing or casing hanger of claim 4, wherein:

the second key of the hanger is axially spaced from and circumferentially aligned with at least one of the plurality of first keys of the hanger; and the locking member comprises a second key axially spaced from and circumferentially aligned with at least one of the plurality of first keys of the locking member.

6. The tubing or casing hanger of claim 5, wherein the hanger comprises an annular shoulder extending radially outwards from the outer surface, the annular shoulder axially spaced from the second key of the hanger.

7. The tubing or casing hanger of claim 4, wherein:

an arcuate gap extends between each first key of the plurality of first keys of the hanger; and an arcuate gap extends between each first key of the plurality of first keys of the locking member.

8. The tubing or casing hanger of claim 1, wherein:

the first key of the hanger comprises an upper arcuate surface and a lower arcuate surface, the lower surface disposed at a first acute angle relative the upper surface; and the upper surface of the first key of the locking member is in disposed at the first acute angle relative the lower surface of the first key of the locking member.

9. A tubing or casing hanger assembly comprising:

a tubing or casing hanger comprising a first key and a second key each disposed on an outer surface of the hanger, wherein the first key comprises an upper arcuate surface and a lower arcuate surface, the lower surface disposed at a first acute angle relative the upper surface;

a packoff assembly disposed about the hanger; and a locking member disposed about the hanger, the locking member comprising a first key disposed on an inner surface of the locking member, wherein the first key comprises an upper arcuate surface and a lower arcuate surface, the upper surface disposed at the first acute angle relative the lower surface;

wherein the locking member comprises a first position where the first key of the locking member is circumferentially spaced from the first key of the hanger, and a second position wherein the first key of the locking member is circumferentially aligned with the first key of the hangar and the upper arcuate surface of the first key of the locking member engages the first key of the hanger while the lower arcuate surface of the first key of the locking member is axially spaced from the second key of the hanger;

wherein the locking member is configured to actuate the packoff assembly from a run-in position to an energized position in response to the application of an axially directed load against the locking member.

10. The tubing or casing hanger of claim 9, wherein, when the locking member is disposed in the second position, the lower surface of the first key of the hanger engages the upper surface of the first key of the locking member at an offset engagement interface.

11. The tubing or casing hanger of claim 10, wherein the offset engagement interface is disposed at a non-orthogonal angle relative to a longitudinal axis of the tubing or casing hanger assembly.

12. The tubing or casing hanger of claim 9, wherein:

the lower surface of the first key of the hanger is disposed at a non-orthogonal angle relative to a longitudinal axis of the tubing or casing hanger assembly; and the upper surface of the first key of the locking member is disposed at a non-orthogonal angle relative to the longitudinal axis of the tubing or casing hanger assembly.

13. The tubing or casing hanger of claim 10, wherein, in response to actuating the locking member from the first position to the second position, the locking member is displaced axially relative to the hanger due to engagement between the first key of the hanger and the first key of the locking member at the offset engagement interface.

14. The tubing or casing hanger of claim 9, wherein:

the second key of the hanger is axially spaced from and circumferentially aligned with the first key of the hanger, the second key comprising an upper arcuate surface and a lower arcuate surface, the lower surface disposed at a first acute angle relative to the upper surface;

the locking member comprises a second key axially spaced from and circumferentially aligned with the first key of the locking member, the second key comprising an upper arcuate surface and a lower arcuate surface, the upper surface disposed at the first acute angle relative to the lower surface; and the hanger comprises an annular shoulder extending radially outwards from the outer surface, the annular shoulder axially spaced from the second key of the hanger.

15. The tubing or casing hanger of claim 9, wherein:

the hanger comprises a plurality of first keys spaced circumferentially about the outer surface of the hanger; and the locking member comprises a plurality of first keys spaced circumferentially about the inner surface of the locking member.

16. A method of actuating a tubing or casing hanger assembly comprising:

disposing a locking member and a packoff assembly about a tubing or casing hanger, the locking member comprising a key disposed on an inner surface thereof and the hanger comprising a first key and a second key each disposed on an outer surface thereof;

rotating the locking member from a first position where the key of the locking member is circumferentially spaced from the key of the hanger to a second position where the key of the locking member circumferentially aligns with the first key of the hangar, and an upper arcuate surface of the key of the locking member engages the first key of the hanger while the lower arcuate surface of the key of the locking member is axially spaced from the second key of the hanger;

coupling the locking member to the hanger in response to rotating the locking member from the first position to the second position; and applying an axially directed load against the locking member to actuate the packoff assembly from a run-in position to an energized position.

17. The method of claim 16, further comprising locking the packoff assembly in the energized position in response to rotating the locking member from the first position to the second position.

18. The method of claim 17, further comprising engaging the key of the locking member with the first key of the hanger at an offset engagement interface.

* * * * *